US008383308B2

(12) United States Patent
Takahashi et al.

(10) Patent No.: US 8,383,308 B2
(45) Date of Patent: Feb. 26, 2013

(54) POSITIVELY CHARGEABLE TWO-COMPONENT DEVELOPER, IMAGE FORMING METHOD, AND IMAGE FORMING APPARATUS

(75) Inventors: Sakon Takahashi, Kanagawa (JP); Daisuke Ishizuka, Kanagawa (JP); Michio Take, Kanagawa (JP); Seijiro Ishimaru, Kanagawa (JP); Chiaki Suzuki, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 908 days.

(21) Appl. No.: 12/260,684

(22) Filed: Oct. 29, 2008

(65) Prior Publication Data

US 2009/0233211 A1 Sep. 17, 2009

(30) Foreign Application Priority Data

Mar. 14, 2008 (JP) ..... 2008-066147

(51) Int. Cl.
*G03G 9/08* (2006.01)

(52) U.S. Cl. ..... 430/108.8; 430/109.4; 430/111.32; 430/124.4; 399/336

(58) Field of Classification Search ..... 430/109.4, 430/108.8, 111.32, 124.4; 399/336
See application file for complete search history.

(56) References Cited

U.S. PATENT DOCUMENTS

| | | | | |
|---|---|---|---|---|
| 4,737,432 | A | 4/1988 | Tanaka et al. | |
| 5,135,833 | A * | 8/1992 | Matsunaga et al. | 430/108.8 |
| 5,468,585 | A * | 11/1995 | Matsumoto et al. | 430/111.4 |
| 5,514,509 | A | 5/1996 | Kawata et al. | |
| 5,741,617 | A * | 4/1998 | Inaba et al. | 430/108.8 |
| 5,928,825 | A * | 7/1999 | Eguchi et al. | 430/108.4 |
| 6,506,530 | B1 * | 1/2003 | Kido et al. | 430/109.4 |
| 6,541,173 | B1 * | 4/2003 | Kido et al. | 430/109.4 |
| 6,593,048 | B2 | 7/2003 | Sasaki et al. | |
| 7,390,605 | B2 * | 6/2008 | Shirai | 430/109.4 |
| 2001/0018157 | A1 * | 8/2001 | Aoki et al. | 430/109.4 |
| 2003/0017407 | A1 * | 1/2003 | Nakamura et al. | 430/108.21 |
| 2004/0209178 | A1 * | 10/2004 | Itakura et al. | 430/108.8 |
| 2006/0051686 | A1 * | 3/2006 | Ide et al. | 430/109.4 |
| 2007/0184372 | A1 * | 8/2007 | Itakura et al. | 430/45.4 |
| 2008/0171280 | A1 * | 7/2008 | Ohmura et al. | 430/109.4 |
| 2010/0051851 | A1 * | 3/2010 | Mitani et al. | 252/62.54 |

FOREIGN PATENT DOCUMENTS

| | | | |
|---|---|---|---|
| JP | A-03-080263 | | 4/1991 |
| JP | A-04-186250 | | 7/1992 |
| JP | A-06-295097 | | 10/1994 |
| JP | 09166883 | A * | 6/1997 |
| JP | A-2000-075549 | | 3/2000 |
| JP | A-2000-305319 | | 11/2000 |
| JP | A-2001-142249 | | 5/2001 |
| JP | A-2001-249492 | | 9/2001 |
| JP | A-2003-098726 | | 4/2003 |
| JP | A-2004-117958 | | 4/2004 |
| JP | 2008020631 | A * | 1/2008 |

OTHER PUBLICATIONS

Partial machine translation of JP 2008-020631 (Jan. 2008).*
Clariant Product Data Sheet for Licocene PP 1302 granules (Jul. 2011).*
Clariant Product Data Sheet for Licowax PE 520 powder (Feb. 2012).*
Toyo International, Hi-Wax Grade and Property data sheet (2005).*
Jun. 18, 2010 Office Action issued in Australian Patent Application No. 2008255278.

* cited by examiner

*Primary Examiner* — Christopher Rodee
(74) *Attorney, Agent, or Firm* — Oliff & Berridge, PLC

(57) ABSTRACT

A positively chargeable two-component developer, including at least a toner and a carrier, wherein the toner contains a binder resin, a colorant, a wax, and a charge control agent, the binder resin contains at least a polyester resin and an addition polymerization resin grafted with a polyolefin, the wax and the addition polymerization resin grafted with a polyolefin are contained at a wax:addition polymerization resin grafted with a polyolefin ratio of from about 40:60 to about 80:20, and the carrier is a magnetic powder having a coating layer containing a methyl-containing silicone resin.

5 Claims, 1 Drawing Sheet

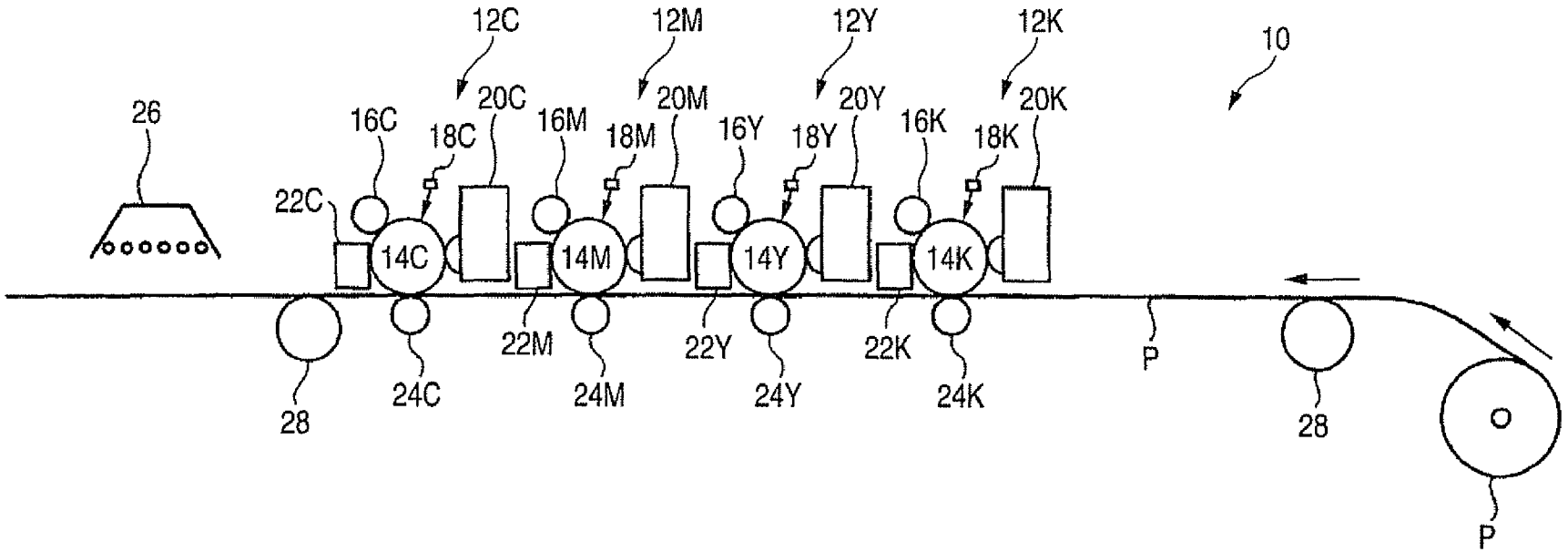
10
12K
20K
18K
14K
16K
22K
24K
12Y
20Y
18Y
14Y
16Y
22Y
24Y
12M
20M
18M
14M
16M
22M
24M
12C
20C
18C
14C
16C
22C
24C
26
28
28
P
P

POSITIVELY CHARGEABLE TWO-COMPONENT DEVELOPER, IMAGE FORMING METHOD, AND IMAGE FORMING APPARATUS

CROSS-REFERENCE TO RELATED APPLICATIONS

This application is based on and claims priority under 35 USC 119 from Japanese Patent Application No. 2008-066147 filed on Mar. 14, 2008.

BACKGROUND

1. Technical Field

The present invention relates to a positively chargeable two-component developer, an image forming method, and an image forming apparatus.

2. Related Art

Image forming apparatuses using an electrophotographic device are utilized as an output unit of a computer. These image forming apparatuses are recently required to run at high speed. Accordingly, toners for image formation are also required to have a performance suited for high-speed printing.

As a toner fixing method, a heat roll method in which a toner is heated directly with a roller, an oven fixing method, or an optical fixing method (flash fixing method) in which an image is fixed by exposure to light or exposure to far infrared rays is employed commonly. Of these, the optical fixing method has advantages that since the toner can be fixed without contact with a transfer-receiving material (a record-receiving material), this method does not cause rolling of paper after fixing, does not cause offset, enables ultra-high speed printing, and facilitates fixing of the toner on stickers or post cards. Particularly, an ultra-high speed image forming apparatus tends to be equipped with an optical fixing unit.

SUMMARY

According to an aspect of the invention, there is provided a positively chargeable two-component developer, including: at least a toner and a carrier, wherein the toner contains a binder resin, a colorant, a wax, and a charge control agent, the binder resin contains at least a polyester resin and an addition polymerization resin grafted with a polyolefin, the wax and the addition polymerization resin grafted with a polyolefin are contained at a wax:addition polymerization resin grafted with a polyolefin ratio of from about 40:60 to about 80:20, and the carrier is a magnetic powder having a coating layer containing a methyl-containing silicone resin.

BRIEF DESCRIPTION OF THE DRAWINGS

Exemplary embodiment(s) of the present invention will be described in detail based on the following figure, wherein:

FIGURE is a schematic configuration diagram illustrating one example of the image forming apparatus according to an aspect of the invention.

DETAILED DESCRIPTION

The present invention will hereinafter be described specifically.

The positively chargeable two-component developer of the invention (which may hereinafter be called "developer" or "two-component developer", simply) is characterized in that it is composed of at least a toner and a carrier; the toner contains a binder resin, a colorant, a wax, and a charge control agent; the binder resin contains at least a polyester resin and an addition polymerization resin grafted with a polyolefin; the wax and the addition polymerization resin grafted with a polyolefin are contained at a wax:addition polymerization resin grafted with a polyolefin ratio of from 40:60 to 80:20; and the carrier is a magnetic powder having a coating layer containing a methyl-containing silicone resin.

The positively chargeable two-component developer of the invention can be used especially preferably as a positively chargeable two-component developer for optical fixing.

It is to be noted that the invention, the term "from A to B" means a range between A and B including A and B. For example, the term "from A to BT" means "A or greater and B or less" or "B or greater and A or less".

It is conventionally difficult to satisfy both fixing and charging durability because of contamination of a carrier with a wax in a toner. On the other hand, difficulty in achieving charge durability is attributable to deterioration or irregularity in capacity to charging the toner or carrier and deterioration in carrier charging capacity due to exfoliation of coat. The present inventors have found that by controlling the composition and structure of the toner and carrier, it is possible to provide a developer capable of overcoming the problem and excellent in charge durability.

It is important to add a charge control agent to a toner and control dispersibility and surface exposure property of internal additives such as charge control agent and wax in order to stabilize the toner charge characteristics and keep them at a constant level. Although a polyester resin has a good fixing property, these internal additives are not sufficient in dispersibility. A developer excellent in charge durability can be provided by employing the above-described constitution while incorporating, in a toner, an addition polymerization resin grafted with a polyolefin.

<Toner>

The positively chargeable two-component developer of the invention is composed of at least a toner and a carrier.

The toner of the positively chargeable two-component developer of the invention contains a binder resin, a colorant, a wax, and a charge control agent.

[Binder Resin]

Although no particular limitation is imposed on the binder resin usable in the invention, the toner of the invention contains, as the binder resin, at least a polyester resin and an addition polymerization resin grafted with a polyolefin.

In addition, as the binder resin, it is possible to use, in combination, a copolymer of styrene and acrylic acid or methacrylic acid, a polyvinyl chloride resin, a phenol resin, an acrylic resin, a methacrylic resin, a polyvinyl acetate resin, a silicone resin, a polyurethane resin, a polyamide resin, a furan resin, an epoxy resin, a xylene resin, a polyvinyl butyral resin, a terpene resin, a coumarone-indene resin, a petroleum resin, or a polyether-polyol resin.

—Addition Polymerization Resin Grafted With Polyolefin—

The addition polymerization resin grafted with a polyolefin which resin is usable in the invention has an addition polymerization resin as a main chain and the main chain is grafted with a polyolefin.

The addition polymerization resin is a resin obtained by addition polymerization of an addition polymerizable monomer.

Examples of the addition polymerizable monomer include radical polymerizable monomers, cationic polymerizable monomers, and anionic polymerizable monomers. Of these, radical polymerizable monomers are preferred, with monomers having an ethylenically unsaturated bond being more preferred.

Examples of the radical polymerizable monomer usable in the invention include olefins such as ethylene, propylene, 1-butene, isobutylene, 1-hexene, 1-dodecene, and 1-octadecene; vinyl aromatics, e.g., styrene, α-substituted styrenes such as α-methylstyrene and α-ethylstyrene, aromatic nucleus-substituted styrenes such as m-methylstyrene, p-methylstyrene, and 2,5-dimethylstyrene, and aromatic nucleus-substituted halogenated styrenes such as p-chlorostyrene, p-bromostyrene, and dibromostyrene; unsaturated carboxylic acid derivatives such as (meth)acrylic acid (the term "(meth)acrylic" means acrylic or methacrylic and this will equally be applicable hereinafter), (meth)acrylate esters, e.g., methyl(meth)acrylate, ethyl(meth)acrylate, propyl(meth) acrylate, butyl(meth)acrylate, pentyl(meth)acrylate, hexyl (meth)acrylate, 2-ethylhexyl(meth)acrylate, glycidyl(meth) acrylate, and benzyl(meth)acrylate, (meth)acrylaldehyde, (meth)acrylonitrile, and (meth)acrylamide; N-vinyl compounds such as N-vinylpyridine and N-vinylpyrrolidone; vinyl esters such as vinyl formate, vinyl acetate and vinyl propionate; halogenated vinyl compounds such as vinyl chloride, vinyl bromide, and vinylidene chloride; N-substituted unsaturated amides such as N-methylolacrylamide, N-ethylolacrylamide, N-propanolacrylamide, N-methylolmaleinamic acid, N-methylolmaleinamic acid ester, N-methylolmaleimide, and N-ethylolmaleimide; conjugated dienes such as butadiene and isoprene; polyfunctional vinyl compounds such as divinylbenzene, divinylnaphthalene, and divinylcylohexane; polyfunctional acrylates such as ethylene glycol di(meth)acrylate, diethylene glycol di(meth)acrylate, propylene glycol di(meth)acrylate, tetramethylene glycol di(meth) acrylate, neopentyl glycol di(meth)acrylate, hexamethylene glycol di(meth)acrylate, trimethylolpropane di(meth)acrylate, trimethylolpropane tri(meth)acrylate, glycerol di(meth) acrylate, glycerol tri(meth)acrylate, pentaerythritol di(meth) acrylate, pentaerythritol tri(meth)acrylate, pentaerythritol tetra(meth)acrylate, dipentaerythritol di(meth)acrylate, dipentaerythritol tri(meth)acrylate, dipentaerythritol tetra (meth)acrylate, dipentaerythritol penta(meth)acrylate, dipentaerythritol hexa(meth)acrylate, sorbitol tri(meth)acrylate, sorbitol tetra(meth)acrylate, sorbitol penta(meth)acrylate, and sorbitol hexa(meth)acrylate; unsaturated nitriles such as (meth)acrylonitrile and cyanostyrene; α,β-unsaturated carboxylic acids such as (meth)acrylic acid, maleic acid, fumaric acid, and itaconic acid and anhydrides thereof; and unsaturated dicarboxylic acid monoesters such as monomethyl maleate, monobutyl maleate, and monomethyl itaconate. Of these, polyvalent monomers such as N-substituted unsaturated amides, conjugated dienes, polyfunctional vinyl compounds, and polyfunctional acrylates can also cause a crosslink reaction in the polymer thus prepared.

In the invention, addition polymerizable monomers may be used either singly or in combination.

The addition polymerization resin grafted with a polyolefin usable in the invention has, as an addition polymerization resin of a main skeleton, preferably a resin obtained by polymerizing at least a styrene monomer and an alkyl ester of an unsaturated carboxylic acid such as (meth)acrylate ester or a monoester of an unsaturated dicarboxylic acid as, more preferably a resin obtained by polymerizing at least a styrene monomer, an alkyl ester of an unsaturated carboxylic acid, and an unsaturated nitrile, especially preferably a styrene-acrylonitrile-butyl acrylate copolymer.

The polyolefin to be grafted on the addition polymerization resin may be a polyolefin obtained by polymerizing one or more known olefins. It contains preferably at least one compound selected from the group consisting of polyethylene, polypropylene, ethylene/propylene copolymer, ethylene/1-butene copolymer, and propylene/1-hexene copolymer, more preferably polypropylene and/or polyethylene.

The olefin is not limited insofar as it is a known olefin. The known olefin is preferably at least one compound selected from the group consisting of ethylene, propylene, 1-butene, isobutylene, 1-hexene, 1-dodecene, and 1-octadecene, more preferably ethylene and/or propylene.

In the addition polymerization resin grafted with a polyolefin, the addition polymerizable resin serving as a main chain may be linked with the polyolefin via a variety of bonds such as carbon-carbon bond, ester bond, and amide bond.

Of these, the polyolefin to be grafted on the addition polymerization resin is preferably a low-density polyethylene from the viewpoint of production ease. The term "low density polyethylene" means a polyethylene having a density of 0.910 g/cm$^3$ or greater and less than 0.930 g/cm$^3$.

When the low density polyethylene is used as the polyolefin, a graft polymerization product between a polyethylene and a vinyl polymer is available, for example, by dissolving the low-density polyethylene in xylene and causing a reaction by adding a vinyl monomer to the xylene solution of the low-density polyethylene under heating.

A production process of the addition polymerization resin grafted with a polyolefin is not particularly limited and any known process can be used. Specific examples of the production process include a process of polymerizing an addition polymerization resin having an ethylenically unsaturated bond with an olefin, and a process of reacting an addition polymerization resin having a reactive group such as carboxyl group, hydroxy group, amino group, bromine atom or iodine atom with a polyolefin having a group reacting the reactive group to form a bond. They also include the process described in JP-A-2004-295079.

Examples of the polymerization process of the addition polymerizable monomer include a process of using a radical polymerization initiator, a cationic polymerization initiator, or an anionic polymerization initiator, a process using self-polymerization with heat or ultraviolet exposure, and a known polymerization process.

As the radical polymerization initiator, cationic polymerization initiator, or anionic polymerization initiator, known initiators can be used. They may be used either singly or two or more initiators may be used in combination.

The addition polymerization resin grafted with a polyolefin is preferably contained in an amount of 0.5 part by weight or greater and not greater than 10 parts by weight, more preferably 0.8 part by weight or greater and not greater than 8 parts by weight, especially preferably 1 part by weight or greater and not greater than 7 parts by weight, each based on 100 parts by weight of the total weight of the toner.

The Tg (glass transition temperature) of the addition polymerization resin grafted with a polyolefin is preferably from 40 to 80° C. The weight-average molecular weight of the addition polymerization resin grafted with a polyolefin is preferably from 3,000 to 50,000.

The amount of the grafted polyolefin in the addition polymerization resin grafted with a polyolefin is preferably 5 parts by weight or greater and not greater than 40 parts by weight, more preferably 8 parts by weight or greater and not greater than 35 parts by weight, especially preferably 10 parts by weight or greater and not greater than 30 parts by weight, based on 100 parts by weight of the addition polymerization resin grafted with a polyolefin. When the amount falls within the above-described range, the size of the wax can be controlled by controlling both the addition amount of the wax itself and the amount of the polyolefin in the addition polymerization resin grafted with a polyolefin which has higher compatibility with the binder resin such as polyester resin than the polyethylene wax. As a result, a ratio of the wax exposed to the toner surface can be adjusted to a preferable range. In addition, by employing the above-described constitution of the invention, internal additives can be dispersed well and the size of each of the wax and charge control agent in the toner can be controlled within a preferred range, leading to a stable charge amount. In addition, since the exposure of the wax to the toner surface is controlled within a preferred range, the scratch resistance of the fixed image is not damaged.

—Polyester Resin—

The polyester resin usable in the invention is available by polycondensation of a carboxylic acid component and an alcohol component. Conventionally known divalent or higher polyvalent carboxylic acids and dihydric or higher polyhydric alcohols can be used.

Specific examples of the divalent carboxylic acid include aliphatic dicarboxylic acids such as maleic acid, fumaric acid, succinic acid, adipic acid, malonic acid, sebacic acid, and mesaconic acid, and anhydrides and lower alkyl esters thereof; aromatic dicarboxylic acids such as phthalic acid, isophthalic acid, terephthalic acid, toluenedicarboxylic acid, and naphthalenedicarboxylic acid, and anhydrides and lower alkyl esters thereof; alkyl- and alkenyl-succinic acids having, on the side chain thereof, a $C_{4-35}$ hydrocarbon group (specifically, dodecenylsuccinic acid and pentadodecenylsuccinic acid), and anhydrides, lower alkyl esters, and acid halides thereof.

Specific examples of the trivalent or higher polyvalent carboxylic acids include trimellitic acid, pyromellitic acid, 1,2,4-cyclohexanetricarboxylic acid, 2,5,7-naphthalenetricarboxylic acid, 1,2,4-naphthalenetricarboxylic acid, 1,2,5-hexanetricarboxylic acid, and 1,2,7,8-octanetetracarboxylic acid, and acid anhydrides, lower alkyl esters, and acid halides thereof.

The polyvalent carboxylic acids serving as a carboxylic acid component in the polyester resin may be used either singly or in combination.

Examples of the diol which is the above-described divalent alcohol include $C_{2-12}$ alkylene glycols such as ethylene glycol, 1,2-propylene glycol, 1,3-propylene glycol, 1,4-butanediol, neopentyl glycol, 1,4-butenediol, 1,5-pentanediol, and 1,6-hexanediol; alkylene glycols such as diethylene glycol, triethylene glycol, dipropylene glycol, polyethylene glycol, polypropylene glycol, and polytetramethylene glycol; $C_{6-30}$ alicyclic diols such as 1,4-cyclohexanedimethanol and hydrogenated bisphenol A; bisphenols such as bisphenol A, bisphenol F, and bisphenol S; and alkylene oxide adducts of a bisphenol.

Examples of the trihydric or higher polyhydric alcohols include $C_{3-20}$ aliphatic polyhydric alcohols such as sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, and trimethylolpropane; and $C_{6-20}$ aromatic polyhydric alcohols such as 1,3,5-trihydroxylmethylbenzene; and alkylene oxide adducts of these polyhydric alcohols.

The addition mol of the alkylene oxide in the alkylene oxide adducts of a divalent or higher polyvalent alcohol is preferably from 1 to 4 mols, more preferably 1 or 2 mols per mol of the hydroxy group.

Although no particular limitation is imposed on the alkylene oxide, it is preferably ethylene oxide and/or propylene oxide.

The polyhydric alcohols to be used as an alcohol component in the polyester resin may be used either singly or in combination.

The Tg (glass transition temperature) of the polyester resin is preferably within a range of from 40 to 80° C. and the weight-average molecular weight of the polyester resin is preferably within a range of from 5,000 to 100,000.

The polyester resin is contained in an amount of preferably from 50 to 90 parts by weight, more preferably from 60 to 90 parts by weight, still more preferably from 70 to 85 parts by weight based on 100 parts by weight of the total weight of the toner. When the amount is within the above-described range, the resulting toner is excellent in fixing property, storage property, powder characteristics, and charging characteristics.

The addition polymerization resin grafted with a polyolefin is contained in an amount of preferably from 1.0 to 20 parts by weight, more preferably from 1.5 to 15 parts by weight, still more preferably from 2.0 to 10 parts by weight, based on 100 parts by weight of the total amount of the toner. When the amount is within the above-described range, the resulting toner is free from contamination of a carrier with a wax and has improved fluidity while maintaining its fixing characteristics.

The toner may contain, as the binder resin, an addition polymerization resin other than the addition polymerization resin grafted with a polyolefin or a polycondensation resin other than the polyester resin.

[Colorant]

The toner usable in the invention contains a colorant.

As the colorant, known pigments and known dyes can be used in the invention. The following are preferred examples of the colorants.

When the toner is a cyan toner, examples of the colorant therefor include cyan pigments such as C.I. Pigment Blue 1, 2, 3, 4, 5, 6, 7, 10, 11, 12, 13, 14, 15, 15:1, 15:2, 15:3, 15:4, 15:6, 16, 17, 23, 60, 65, 73, 83, and 180, C.I. Vat Cyan 1, 3, and 20, iron blue, cobalt blue, alkali blue lake, phthalocyanine blue, nonmetal phthalocyanine blue, partially chlorinated phthalocyanine blue, Fast Sky Blue, and Indanthrene Blue BC; and cyan dyes such as C.I. Solvent Cyan 79 and 162.

When the toner is a magenta toner, examples of the colorant therefor include magenta pigments such as C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 163, 184, 202, 206, 207, and 209, and Pigment Violet 19; magenta dyes such as C.I. Solvent Red 1, 3, 8, 23, 24, 25, 27, 30, 49, 81, 82, 83, 84, 100, 109, and 121, C.I. Disperse Red 9, C.I. Basic Red 1, 2, 9, 12, 13, 14, 15, 17, 18, 22, 23, 24, 27, 29, 32, 34, 35, 36, 37, 38, 39, and 40; iron red oxide, Permanent Red 4R, Lithol Red, pyrazolone red, Watchung red (calcium lake), Lake Red D, Brilliant Carmine 6B, eosin lake, Rotamine Lake B, alizarin lake, and Brilliant Carmine 3B.

When the toner is a yellow toner, examples of the colorants therefor include yellow pigments such as C.I. Pigment Yellow 2, 3, 15, 16, 17, 74, 97, 180, 185, and 139.

When the toner is a black toner, examples of the colorants therefor include magnetic powders such as carbon black, active carbon, titanium black, iron powder, magnetite, and ferrite, and Mn-containing nonmagnetic powder. Moreover, a black toner containing a mixture of plural pigments such as yellow, magenta, cyan, red, green and blue pigments may be used.

The content of the colorant in the toner is preferably 1.5 wt. % or greater and not greater than 20 wt. %, more preferably 2 wt. % or greater and not greater than 15 wt. % based on the total weight of the toner.

[Wax]

The toner usable in the invention contains a wax.

Although no particular limitation is imposed on the wax to be used for the toner, a wax containing a polyolefin wax is preferred, a wax containing a polyethylene wax is more preferred, and a wax composed only of a polyethylene wax is still more preferred.

A polyethylene wax having a weight average molecular weight of 2,000 or greater is preferred, with that having a weight average molecular weight of 3,000 or greater being more preferred. Although no particular limitation is imposed on the weight average molecular weight, the upper limit of the weight average molecular weight of the polyethylene wax is preferably 20,000 or less.

Examples of the wax usable in the invention include polyolefin wax, ester wax, copolymerization product of polypropylene or polyethylene and polypropylene, polyglycerin wax, microcrystalline wax, paraffin wax, carnauba wax, sasol wax, montanate wax, deoxidized carnauba wax, unsaturated fatty acids such as palmitic acid, stearic acid, montanic acid, brassidic acid, eleostearic acid, and parinaric acid; saturated alcohols such as stearin alcohol, aralkyl alcohol, behenyl alcohol, carnaubyl alcohol, ceryl alcohol, melissyl alcohol, and long-chain alkyl alcohols having a long chain alkyl group; polyhydric alcohols such as sorbitol; fatty acid amides such as linoleic acid amide, oleic acid amide, and lauric acid amide; saturated fatty acid bisamides such as methylenebisstearic acid amide, ethylenebiscapric acid amide, ethylenebislauric acid amide and hexamethylenebisstearic acid amide; unsaturated fatty acid amides such as ethylenebisoleic acid amide, hexamethylenebisoleic acid amide, N,N'-dioleyladipic acid amide, and N,N'-dioleylsebacic acid amide; aromatic bisamides such as m-xylenebisstearic acid amide and N,N'-distearylisophthalic acid amide; fatty acid metal salts (generally called metal soaps) such as calcium stearate, calcium laurate, zinc stearate and magnesium stearate; waxes obtained by grafting a vinyl monomer such as styrene or acrylic acid onto an aliphatic hydrocarbon type wax; partially esterified products of a fatty acid such as behenic acid monoglyceride and a polyhydric alcohol; and methyl ester compounds having a hydroxyl group and obtained by hydrogenating a vegetable oil or fat.

As the wax, a wax material having an endothermic peak in a temperature range of from 50 to 160° C. in DSC measurement (differential scanning calorimetry) is preferred. In the above DSC measurement, it is preferred to measure using an internal heat input compensation type differential scanning calorimeter with high accuracy in light of measuring principle.

The content of all the wax components in the toner is preferably 0.5 wt. % or greater and not greater than 15 wt. %, more preferably 1 wt. % or greater and not greater than 10 wt. %, still more preferably 1 wt. % or greater and not greater than 6 wt. %.

The wax and the addition polymerization resin grafted with a polyolefin are contained at a wax:addition polymerization resin grafted with a polyolefin ratio ranging from about 40:60 to about 80:20, preferably about 40:60 to about 70:30. When a ratio of the wax in the wax:addition polymerization resin grafted with a polyolefin ratio exceeds 80:20, the dispersibility of the wax deteriorates, causing the spent of the wax to the carrier, reduction in charge, and uneven distribution of an external additive. When the wax:addition polymerization resin grafted with a polyolefin ratio is below 40:60, the wax has an unduly small diameter, which interferes with the fixing effects and fixing disorder is apt to occur.

[Charge Control Agent]

The toner usable in the invention contains a charge control agent.

No particular limitation is imposed on the charge control agent and known ones can be used depending on the using purpose. Examples of the positively chargeable charge control agent include nigrosine dyes; onium salts such as quaternary ammonium salts, e.g., tributylbenzylammonium-1-hydroxy-4-naphthosulfonate and tetrabutylammonium teterafluoroborate, and phosphonium salts which are analogs thereof, and lake pigments of these salts; triphenylmethane dyes; metal salts of a higher fatty acid; diorganotin oxides such as dibutyltin oxide, dioctyltin oxide, and dicyclohexyltin oxide; diorganotin borates such as dibutyltin borate; guanidine compounds; imidazole compounds; and aminoacrylic resins. Of these, nigrosine dyes and quaternary ammonium salts are preferred. These charge control agents may be used either singly or in combination.

The charge control agent and the addition polymerization resin grafted with a polyolefin are contained at a charge control agent:addition polymerization resin grafted with a polyolefin ratio of from 30:70 to 80:20, preferably from 30:70 to 70:30. Within the above-described range, the dispersibility of the charge control agent is excellent, spent to the carrier does not occur easily, and widening of the charge distribution can be suppressed. In addition, since the charge control agent is not easily incorporated in the addition polymerization resin, the resulting toner has excellent charging characteristics.

As described above, by controlling the amount of the wax and the amount of the charge control agent, in the toner, relative to the addition polymerization resin grafted with a polyolefin within an appropriate range, the amount of the wax and the charge control agent exposed to the toner surface can be controlled appropriately so that a stable charge property can be attained. In addition, contamination of a carrier with the wax can be prevented, making it possible to desirably prevent scattering of the toner without impairing the scratch resistance during from the initial stage and after the passage of time.

Moreover, by controlling both the amount of the polyolefin in the addition polymerization resin grafted with a polyolefin which has high compatibility with the charge control agent and an addition ratio of the charge control agent itself, the exposure ratio of the charge control agent to the toner surface can be adjusted to a preferable range.

With an increase in the number of printed sheets, the adhesion between the wax and the charge control agent occurs. It is therefore preferred to control the size of each of the wax and the charge control agent to fall within an adequate range and thereby prevent the wax and the charge control agent from existing in an adhered state in order to prevent scattering of the toner which will otherwise occur by the contamination of the carrier with thus-adhered substances. By controlling both the addition ratio of the charge control agent and the addition ratio of the wax while controlling the amount of the polyolefin in the addition polymerization resin grafted with a polyolefin to fall within the above-described range, more specifically, by adding the polyolefin in an amount of preferably from 5 to 40 parts by weight, more preferably from 8 to 35 parts by weight, still more preferably from 10 to 30 parts by weight based on 100 parts by weight of the addition polymerization resin grafted with a polyolefin, it is possible to prevent the wax and the charge control agent from existing in the adhered state. This also has an influence on the appropriate control of the amount of the wax exposed to the toner surface, the amount of the charge control agent, and their existing state, making it possible to obtain a stable charging property and at the same time, prevent the contamination of the carrier with the wax. As a result, it is possible to prevent occurrence of toner scattering without impairing the scratch resistance.

When the developer of the invention is used for an image forming apparatus or image forming method using the optical fixing system, the toner may contain an infrared absorber.

In particular, color toners such as cyan toner, magenta toner, and yellow toner preferably contain an infrared absorber.

Known infrared absorbers are usable for the invention and examples include cyanine compounds, merocyanine compound, benzene-thiol metal complexes, mercaptophenol metal complexes, aromatic diamine metal complexes, diimmonium compounds, aminum compounds, nickel complex compounds, phthalocyanine compounds, anthraquinone compounds, and naphthalocyanine compounds.

Specific examples of the infrared absorber include nickel metal complex infrared absorbers ("SIR-130", "SIR-132", each, trade name; product of Mitsui Chemicals), bis(dithiobenzyl)nickel ("MIR-101", trade name, product of Midori Kagaku), bis[1,2-bis(p-methoxyphenyl)-1,2-ethylenedithiolate]nickel ("MIR-102", trade name, product of Midori Kagaku), tetra-n-butylammoniumbis(cis-1,2-diphenyl-1,2-ethylenedithiolate)nickel ("MIR-1011", trade name, product of Midori Kagaku), tetra-n-butylammoniumbis[1,2-bis(p-methoxyphenyl)-1,2-ethylenedithiolate]nickel ("MIR-1021", trade name, product of Midori Kagaku), bis(4-tert-1,2-butyl-1,2-dithiophenolate)nickel-tetra-n-butylammonium ("BBDT-NI", trade name; product of Sumitomo Seika Chemicals), cyanine infrared absorbers ("IRF-106", "IRE-107", each, trade name; product of FUJIFILM), cyanine infrared absorbers ("YKR2900", trade name; product of YAMAMOTO CHEMICALS), aminium and diimmonium infrared absorbers ("NIR-AM1", and "NIR-IM1", each, trade name; product of Nagase ChemteX), immonium compounds ("CIR-1080" and "CIR-1081", each, trade name; product of Japan Carlit), aminium compounds ("CIR-960" and "CIR-961", each, trade name; product of Japan Carlit), anthraquinone compounds ("IR-750", trade name; product of Nippon Kayaku), aminium compounds ("IRG-002", "IRG-003", and "IRG-003K, each, trade name; product of Nippon Kayaku), polymethine compounds ("IR-820B", trade name; product of Nippon Kayaku), diimmonium compounds ("IRG-022" and "IRG-023", each, trade name; product of Nippon Kayaku), cyanine compounds ("CY-2", "CY-4", and "CY-9", each, trade name; product of Nippon Kayaku), soluble phthalocyanine ("TX-305A", trade name; product of NIPPON SHOKUBAI), naphthalocyanines ("YKR5010", trade name; product of YAMAMOTO CHEMICALS, "Sample 1", product of Sanyo Color Works), and inorganic materials ("Ytterbium UU-HP", trade name; product of Shin-Etsu Chemical and indium tin oxide, product of Sumitomo Metal Industries). When optical fixing is performed, diimmonium, aminium, naphthalocyanine, and cyanine are preferred among these infrared absorbers.

[External Additives]

The toner usable in the invention may contain an external additive such as inorganic particles.

The external additive to be added externally to the toner particles is preferably within a range of preferably from 0.01 to 5 parts by weight, more preferably from 0.1 to 3.0 parts by weight, based on 100 parts by weight of the toner particles before external addition.

Examples of the inorganic particles as the external additive include silica powder, alumina, titanium oxide, barium titanate, magnesium titanate, calcium titanate, strontium titanate, zinc oxide, quartz sand, clay, mica, wollastonite, diatomaceous earth, chromium oxide, cerium oxide, red iron oxide, antimony trioxide, magnesium oxide, zirconium oxide, barium sulfate, barium carbonate, calcium carbonate, silicon carbide, and silicon nitride. The toner containing at least one of silica, titanium oxide, and alumina is especially preferred.

In addition, metal salts of a higher fatty acid such as zinc stearate and organic particles composed of, for example, a styrene polymer, a (meth)acrylic polymer, an ethylene polymer, an ester polymer, a melamine polymer, an amide polymer, an allyl phthalate polymer, a silicone polymer, a fluorine polymer such as vinylidene fluoride, or a higher alcohol may be added.

Of these, silica is preferred, with hydrophobic silica being more preferred. Silica which is surface-treated with an amino silane coupling agent in order to enhance positive chargeability is especially preferred.

The external additive, and optionally, desired additives may be sufficiently mixed with the toner in a mixer such as a Henschel mixer to externally add it to the toner.

[Volume-Average Particle Size of Toner Particles]

The volume-average particle size of the toner particles is preferably 4 μm or greater and not greater than 12 μm.

The volume-average particle size of the toner particles can be measured using a measuring instrument such as "Coulter Multisizer II" (trade name; product of Beckman Coulter) or "Coulter Counter TA-II" (trade name; product of Beckman Coulter). Described specifically, from 0.5 to 50 mg of a sample to be measured is added to a surfactant serving as a dispersant and then, the resulting mixture is added to from 100 to 150 ml of an electrolyte. The electrolyte in which the sample has been suspended is dispersed for one minute by an ultrasonic dispersing machine and a particle size distribution of particles having a particle size within a range of from 2.0 to 60 μm is measured using the "Coulter Counter TA-II" having an aperture having an aperture diameter of 100 μm. The number of particles to be measured is 50,000. The particle size distribution of the toner particles thus measured is divided into particle size ranges (channels) and a cumulative distribution curve is drawn from the range of smaller particles. On the curve, the particle size giving an accumulation of 50% is defined as a volume-average particle size $D_{50}$.

[Production Process of Toner]

No particular limitation is imposed on the production process of the toner usable in the invention and the toner can be prepared by known toner production processes such as pulverization process.

When the pulverization process is employed, the toner can be produced, for example, in the following manner. First, components such as binder resin, wax, charge control agent, and colorant are mixed. The resulting mixture is then melt-kneaded using a kneader or extruder. The resulting mass is crudely pulverized, followed by fine pulverization in a jet mill. By treating them with an air separator, toner particles having a desired particle size can be obtained. An external additive such as silica is added to the resulting toner particles if necessary to complete the toner production.

<Carrier>

The positively chargeable two-component developer of the invention contains at least the toner and a carrier.

The carrier of the positively chargeable two-component developer of the invention is a magnetic powder having a coating layer containing a methyl-containing silicone resin.

The carrier having a coating layer containing a methyl-containing silicone resin is suited for maintaining charging of the toner having controlled dispersibility. A silicone resin having only an alkyl long chain or phenyl group is apt to cause so-called spent, that is, a phenomenon of causing poor charging due to adhesion of the toner components such as a diameter-reduced charge control agent or wax to the carrier and in addition, exfoliation of the coating resin.

Even if the carrier having the coating layer containing a methyl-containing silicone resin is used, a toner not containing a charge control agent or a toner whose wax content is not controlled to fall within the above-described adequate range has poor charge durability because of deterioration in charging performance. A toner is replaced by a new one so that when the toner does not have sufficient chargeability, the developer has reduced chargeability and loses charge durability. In a toner whose wax content is not controlled to fall within the above-described adequate range or whose wax has a large disperse diameter, even the carrier having a coating layer containing a methyl-containing silicone resin causes spent, resulting in deterioration in the carrier charging capacity.

Thus, it is important to use a combination of dispersibility of the internal additives in the toner and use of an appropriate resin for the coating layer of the carrier and absence of either one of them may result in failure to attain charge durability as a developer.

The silicone resin is a silicon polymer having a substituent directly bonded to a silicon atom thereof and is represented by the following formula (1):

$$(R_nSiO_{(4-n)/2})_m \quad (1).$$

In the formula (1), R represents a substituent, n stands for an integer from 1 to 3, and m stands for an integer of 2 or greater. When there are a plurality of Rs, Rs may be the same or different.

Examples of the substituent R include alkyl groups, alkyl fluoride groups, aryl groups, vinyl group, hydrogen atom, halogen atoms, alkoxy groups, acyloxy groups, and alkylamino groups.

The polymer represented by the formula (1) is, for example, a polymer represented by $(RnSiO_{(4-n)/2})_m$ and having a methyl group as at least one of Rs.

It is preferred that 90% or greater, more preferably 95% or greater of all the silicon atoms of the methyl-containing silicone resin constitute a structural unit represented by the following formula (2):

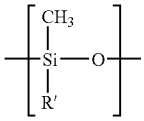

(2)

In the formula (2), R' represents an alkyl group, an alkyl fluoride group, an aryl group, a vinyl group, a hydrogen atom, a halogen atom, an alkoxy group, an acyloxy group, or an alkylamino group, preferably an alkyl group, an aryl group, or an alkoxy group, more preferably a methyl group, a phenyl group, or a methoxy group, still more preferably a methyl group or a methoxy group.

The methyl-containing silicone resin may have one of the structural units represented by the formula (2) or two or more of them in combination.

The carrier usable in the invention may have, in the coating layer thereof, one of the methyl-containing silicone resins or two or more of them in combination.

Examples of the material of the magnetic powder serving as a core material of the carrier usable in the invention include magnetic metals such as iron, steel, nickel, and cobalt; and magnetic oxides such as ferrite and magnetite.

The ferrite is, for example, represented by the following formula:

$$(MO)_x(Fe_2O_3)_y$$

wherein, M represents at least one metal element selected from the group consisting of Cu, Zn, Fe, Mg, Mn, Ca, Li, Ti, Ni, Sn, Sr, Al, Ba, Co, and Mo, and X and Y each represents a weight mol ratio with the proviso that X+Y=100. The ferrite contains preferably at least one metal element selected from the group consisting of Cu, Zn, and Mn.

The magnetic powder has an average particle size of preferably from 10 to 150 μm, more preferably from 20 to 120 μm.

Resistance control and a carrier-coating resin amount are important for achieving further improvement in the image quality and charge durability. The lower the resistance of the carrier, the higher the developing property. The carrier having a lower resistance can be used for higher speed operation and higher image density.

Although the carrier-coating resin amount varies, depending on the particle size of the carrier, it is preferably 0.3 wt. % or greater, more preferably 1.0 wt. % or greater, and preferably not greater than 4 wt. %, each based on the total weight of the carrier. When the resin amount is within the above-described range, the coating layer does not easily peel so that the carrier has sufficient durability, and at the same time has excellent fluidity.

The carrier preferably has a conductive powder in the coating layer to control the carrier resistance.

A known conductive powder can be used in the invention as the conductive powder. Examples of it include metal powders such as gold, silver and copper, and titanium oxide, zinc oxide, barium sulfate, aluminum borate, potassium titanate, tin oxide, and carbon black. Carbon black is preferred from the viewpoint of the strength of the coating layer. The conductive powder is preferably in particulate form.

The carrier resistance is preferably $10^{13}$ Ω/cm or less, more preferably from $10^5$ to $10^{12}$ Ω/cm, still more preferably from $10^6$ to $10^{11}$ Ω/cm. When the carrier resistance is within the above-described range, reduction in a development amount does not occur at high speed development and a defect, that is, a white spot phenomenon between the halftone and solid image does not occur easily.

The carrier usable in the invention has an average particle size of from 10 to 100 μm, more preferably from 20 to 80 μm.

There is no particular limitation imposed on the production process of the carrier and any known process can be employed. For example, it can be obtained by coating the magnetic powder with the methyl-containing silicone resin by the spray dry method with a fluidized bed, the rotary dry method, or the liquid immersion dry method with a universal stirrer.

Various resins other than the methyl-containing silicone resin are usable as a resin to be used for a coating layer of the core surface of the carrier usable in the invention. Examples include fluorine resins, acrylic resins, epoxy resins, polyester resins, fluoroacrylic resins, acrylic/styrene resins, silicone resins, silicone resins modified with an acrylic, polyester, epoxy, alkyd, or urethane resin, and crosslink type fluorine-modified silicone resins.

The resin component in the coating layer of the carrier usable in the invention is preferably composed only of the methyl-containing silicone resin.

The coating layer of the carrier may contain a charge control agent, resistance control agent, and the like if necessary.

The two-component developer of the invention is produced by mixing the toner and the carrier.

In the two-component developer of the invention, the toner and the carrier are mixed at a toner:carrier weight ratio of preferably from 1:99 to 20:80, more preferably from 3:97 to 12:88.

Although the preparation process of the two-component developer is not particularly limited, examples of it include mixing in a V-blender.

<Image Forming Method>

No particular limitation is imposed on the image forming method of the invention insofar as it forms a toner image on a transfer-receiving material (a record-receiving medium) by using the developer of the invention. The image forming method preferably includes an optical fixing step.

The image forming method of the invention includes a step of forming an electrostatic latent image on the surface of a latent image bearing member, a step of developing the electrostatic latent image formed on the surface of the latent image bearing member with a developer containing a toner to form a toner image, a step of transferring the toner image formed on the surface of the latent image bearing member to the surface of a transfer-receiving material, and a step of optically fixing the toner image transferred to the surface of a transfer-receiving material, wherein as the developer, the positively chargeable two-component developer of the invention is used.

The developer of the invention can also be used in a typical image forming method employing an electrostatic image developing system (electrophotographic system). The latent image forming step, the developing step, and the transferring step are described, for example, in JP-A-56-40868 and JP-A-49-91231. The image forming method of the invention can be performed using image forming apparatuses such as copying machine and facsimile which are known per se.

In the image forming method of the invention, a processing speed of the whole steps is preferably 1,000 mm/sec or greater, more preferably from 1,000 to 10,000 mm/sec.

The latent image forming step is a step of forming an electrostatic latent image on a latent image bearing member. In one preferred example, the formation of an electrostatic latent image by image exposure can be achieved, for example, by giving a uniform electrostatic charge to the surface of a latent image bearing member such as a photoreceptor drum, irradiating an optical image to the latent image bearing member by various means to partially erase the electrostatic charge on the latent image bearing member and thereby form an electrostatic latent image. Alternatively, an electrostatic latent image corresponding to image data can be formed on a latent image bearing member, for example, by irradiating a laser light to erase a surface charge from a specific area.

The developing step is a step of developing the electrostatic latent image formed on the surface of the latent image bearing member with a toner-containing developer to form a toner image. This can be achieved by attaching the toner-containing developer of the invention to the latent image portion of the latent image bearing member in which electrostatic charges have remained.

The transferring step is a step of transferring the toner image to a transfer-receiving material. This can be achieved typically by electrostatically transferring the toner image to a recording medium such as recording paper.

In the fixing step, the toner image transferred to the recording medium such as recording paper is fixed by an optical fixing apparatus or thermally fixing apparatus to form a duplicated image. Target duplicated products (such as printed matters) can be obtained after such a series of processing steps.

In optical fixing in the fixing step, known optical fixing method such as flash fixing method and infrared irradiation fixing method can be used.

In the fixing step, a flash light, far infrared radiation, a halogen light, and the like can be preferably used as a light source. As the flash light, a suitable one selected from lights of a wide wavelength range from visible light to near infrared light can be used, depending on the specification of an optical fixing apparatus to be employed. In particular, the toner can be fixed efficiently by using the light of a Xenon lamp as the flash light.

It is also recommended to use a halogen light in combination with the flash light for fixing in order to fix the toner sufficiently and achieve long-term stability.

The image forming method of the invention may include a cleaning step if desired. The cleaning step is a step of eliminating the electrostatic image developer remained on the electrostatic latent image carrier.

The image forming method of the invention may further include a recycling step. The recycling step is a step of transferring the electrostatic-image-developing toner which has been collected in the cleaning step, to a developer layer. The image forming method including this recycling step can be performed using an image forming apparatus employing a toner recycling system such as copying machine or facsimile. The method of the invention can also be applied to a recycle system which does not have the cleaning step and collects the toner simultaneously with development.

The image forming method based on electrophotography is widely known in this technical field so that detailed description on it is omitted. An image forming method based on ionography instead of electrophotography can also provide satisfactory effects.

<Image Forming Apparatus>

Although the image forming apparatus of the invention is not particular limited insofar as it forms a toner image on a transfer-receiving material (a record-receiving medium) with the developer of the invention, it has preferably an optically fixing unit.

It is more preferred that the image forming apparatus of the invention has a latent image bearing member, a charging unit that charges the latent image bearing member, a exposing unit that exposes the charged latent image bearing member to form an electrostatic latent image on the latent image bearing member, a transferring unit that transfers the toner image from the latent image bearing member to the surface of a transfer-receiving material, and a fixing unit that optically fixes the toner image transferred to the surface of the transfer-receiving material, wherein as the developer, the positively chargeable two-component developer of the invention is used. By using the transfer unit, the toner image may be transferred more than twice by using an intermediate transfer member.

For the latent image bearing member and each of the above-described units, the constitution described in each step of the image forming method can be employed preferably.

As each of the above-described units, a known unit in the image forming apparatus can be utilized. The image forming apparatus to be used in the invention may contain a unit or apparatus other than the above-described constitution.

The image forming apparatus to be used in the invention may operate a plurality of the above-described units simultaneously.

Preferred examples of a light source (fixing unit) to be used in optical fixing in the invention include ordinary halogen lamps, mercury lamps, flash lamps, and infrared laser. Of these, a flash lamp is especially preferred because it enables instantaneous fixing and energy saving.

One example of the image forming apparatus of the invention will next be described referring to an accompanied drawing.

FIGURE is a schematic configuration diagram showing one example of the image forming apparatus of the invention.

In an image forming apparatus 10 illustrated in FIGURE, a recording medium P in a roll form is fed by a paper feed roller 28. On one side of the recording medium P fed in such a way, four image forming units 12 (black (K), yellow (Y), magnet (M), and cyan (C)) are disposed in parallel to each other from the upstream side to the downstream side of the feed direction of the recording medium P. Further, a fixing unit 26 having an optical fixing system is disposed on the downstream side of the image forming units 12 (K, Y, M, C).

The black image forming unit 12K is an image forming unit having a known electrophotographic system. Described specifically, a photoreceptor 14*k* has, at the periphery thereof, a charger 16K, an exposure unit 18K, a developing apparatus 20K, and a cleaner 22K and has, via the recording medium P, a transfer unit 24K. The yellow image forming unit 12Y, the magenta image forming unit 12M, and the cyan image forming unit 12C have also similar members.

For monotone printing, only the black image forming unit (K) may be disposed as the image forming unit 12.

As the photoreceptors 14 (K, Y, M, C) an inorganic receptor such as amorphous silicon or selenium or an organic photoreceptor such as polysilane or phthalocyanine is typically usable, but an amorphous silicon photoreceptor is especially preferred from the viewpoint of long operating life.

As the fixing unit 26, use of a flash lamp such as xenon lamp, neon lamp, argon lamp, or krypton lamp is preferred.

In the image forming apparatus 10 illustrated in FIGURE, toner images are transferred successively by the image forming units 12K, 12Y, 12M, and 12C onto the recording medium P pulled from the roll in accordance with a known electrophotographic system and then, the toner images are optically fixed by the fixing unit 26 to form images.

Since the light sources as the optical fixing unit differ in the strongest emission peak with the kind, the most suited optical absorption characteristics in the near infrared region, which are required corresponding to them, also differ among them. The optical absorption characteristics in the near infrared region however can be easily adjusted by controlling the molecular structure.

The image forming apparatus of the invention may be equipped with at least a toner cartridge to be filled with a toner for supplying it to a developing unit disposed inside of the image forming apparatus.

The image forming units 12K, 12Y, 12M, and 12C illustrated in FIGURE may be connected to toner cartridges corresponding to respective image forming units (colors) via a developer supplying tube which is not illustrated. When an amount of the toner which has remained in the toner cartridge becomes small, the toner cartridge may be replaced by a new one.

EXAMPLES

Examples of the invention will next be described in detail. It should however be borne in mind that the invention is not limited by them.

<Preparation of Toner>

(Synthesis of Addition Polymerization Resin)

In a pressure reactor made of stainless are charged 80 parts by weight of xylene, 10 parts by weight of a polypropylene wax ("NP105", trade name; product of Mitsui Chemicals), and 10 parts by weight of a polyethylene wax ("PE520", trade name product of Clariant). After the reactor is purged sufficiently with nitrogen, the temperature is raised to 170° C. while hermetical sealing the container. At the temperature, a mixture composed of 5 parts by weight of acrylonitrile, 65 parts by weight of styrene, 10 parts by weight of n-butyl acrylate, and 1 part by weight of di-t-butyl peroxide was added dropwise over 4 hours. The reaction mixture is maintained at 170° C. for one hour. From the resulting xylene solution of the mixture, xylene is distilled off to obtain a solid. The solid is dissolved in toluene 5 times the amount of the solid. A soluble content is added dropwise to acetone 10 times the amount of toluene and a precipitate thus obtained is dried to separate an addition polymerization resin (Graft polymer 1).

Graft polymer 1 thus obtained has a Tg of 58° C., a weight average molecular weight of 9,430, and a number average molecular weight of 2,720.

| (Preparation of Toner 1) | |
|---|---|
| Polyester resin<br>(Polyester resin obtained from 2 mol propylene oxide adduct of bisphenol A/2 mol ethylene oxide adduct of bisphenol A/terephthalic acid/trimellitic acid: Tg = 62° C., weight average molecular weight: 38,000) | 79 parts by weight |
| Addition polymerization resin<br>(Graft Polymer 1) | 3 parts by weight |
| Carbon black<br>("#25", trade name; product of Mitsubishi Chemical) | 10 parts by weight |
| Polyethylene wax<br>("400P", trade name; product of Mitsui Chemicals, weight average molecular weight: 4,000) | 5 parts by weight |
| Positive charge control agent<br>(Nigrosine dye: "Bontron N-04", trade name; product of Orient Chemical Industries) | 3 parts by weight |

The above-described composition is mixed in a Henschel mixer. The mixture is kneaded under heat by an extruder set at 105° C. The kneaded mass is cooled, followed by crude pulverization, fine pulverization, and classification to give a volume average particle size $D_{50}$ of 9 μm. Mother particles of the toner are thus obtained.

In a Henschel mixer, 100 parts by weight of the mother particles of the toner and 1.0 part by weight of hydrophobic silica particles ("RA200H", trade name, product of Nippon Aerosil) are mixed, followed by sifting through a sieve having openings of 50 μm to obtain Positively chargeable toner 1.

Toners 2 to 5 having the compositions shown below in Table 1 are prepared as described above by using similar materials.

(Preparation of Carrier)

A coating resin solution having a resin solid content of 10 wt. % is prepared by diluting each of the coating agents described below in Table 2 with toluene. A carrier coating solution is then prepared by adding 15 wt. % of carbon black ("Ketjen Black", trade name; product of Lion Corporation) based on the resin weight in the coating resin solution and stirring the resulting mixture in a paint shaker containing glass beads for 30 minutes.

In a mixer having an agitating blade and configured to reduce pressure and raise temperature, 5,000 parts by weight of the magnetic powder (core) described below in Table 2 and 800 parts by weight of the carrier coating solution obtained above are charged and the mixture is stirred (in Carrier 4, the amount of the carrier coating solution is changed to 500 parts by weight). The temperature in the tank is set at 80° C. and stirring is performed for 15 minutes at 50 kPa while applying a shear stress. Then, stirring and drying are performed at 101 kPa for 20 minutes. The carrier thus obtained is flattened to give a thickness of 1 cm or less, followed by heat treatment at 150° C. for 2 hours. The heat source is then turned off and the temperature is reduced gradually. After cooling over night, the carrier is taken out. The carrier thus taken out is sifted through a 125-μm sieve to remove crude powders, whereby Carriers 1 to 5 shown below in Table 2 are obtained.

TABLE 1

| Toner | Polyester (parts by weight) | Polyethylene wax (parts by weight) | Addition polymerization resin (parts by weight) | Charge control agent (parts by weight) | Wax:addition polymerization resin (weight ratio) | Charge control agent:addition polymerization resin (weight ratio) | Carbon black (wt. %) |
|---|---|---|---|---|---|---|---|
| 1 | 79 | 5 | 3 | 3 | 63:37 | 50:50 | 10 |
| 2 | 80.5 | 5 | 1.5 | 3 | 77:23 | 33:67 | 10 |
| 3 | 75 | 5 | 7 | 3 | 42:58 | 70:30 | 10 |
| 4 | 82 | 5 | 0 | 3 | — | — | 10 |
| 5 | 81 | 5 | 4 | 0 | 56:44 | — | 10 |

TABLE 2

| Carrier | Core (magnetic powder) | Coating agent | Internal additive | Coating amount (wt. %) | Average particle size D50 (μm) | Resistance (log (Ω/cm) when 1000 V is applied |
|---|---|---|---|---|---|---|
| 1 | "MF-100" (trade name; product of Powdertech) | Dimethylsilicone ("SR2410", trade name; product of Dow Corning Toray) | Ketjen Black | 1.6 | 103 | 7.2 |
| 2 | "MF-100" (trade name; product of Powdertech) | Methylphenylsilicone ("TSR144", trade name, product of GE Toshiba Silicone) | Ketjen Black | 1.6 | 105 | 7.3 |
| 3 | "MF-100" (trade name: product of Powdertech) | Dimethylsilicone ("SR2410", trade name; product of Dow Corning Toray) | Ketjen Black | 1.5 | 102 | 8.8 |
| 4 | "MF-100" (trade name; product of Powdertech) | Dimethylsilicone ("SR2410", trade name; product of Dow Corning Toray) | Ketjen Black | 1.1 | 102 | 6.5 |
| 5 | "MF-100" (trade name; product of Powdertech) | Acryl-modified silicone ("KR-9706", trade name, product of Shin-etsu Chemical) | Ketjen Black | 1.6 | 102 | 7.1 |

(Measurement Method of Resistance)

The resistance (Ω/cm) of the carrier is measured in the following manner. The measurement is performed at a temperature of 20° C. and 50% RH.

A carrier to be measured is flatly placed on the surface of a circular jig equipped with an electrode plate of 20 $cm^2$ to form a carrier layer having a thickness of from about 0.01 to 0.03 cm. Another electrode plate of 20 $cm^2$ similar to the above one is placed on the carrier layer to sandwich the carrier layer between the two electrodes. After a load of 4 kg is applied to the electrode plate placed on the carrier layer to eliminate the space between them, the thickness (mm) of the carrier layer is measured. Both of the electrode plates on and under the carrier layer are connected to an electrometer and a high voltage power supply. A high voltage is applied to both of the electrode plates so as to produce an electric field of $10^{3.5}$ V/cm and the carrier resistance (Ω/cm) is calculated by reading the current value (A) flowing at that time. The carrier resistance (Ω/cm) is calculated in accordance with the following equation (3).

$$R=E\times 20/(I-I_0)/L \quad (3)$$

wherein, R represents the resistance (Ω/cm) of a carrier, E represents an applied voltage (V), I represents a current value (A), $I_0$ represents a current value (A) at an applied voltage of 0V, and L represents the thickness (cm) of a carrier layer. The coefficient 20 means the area ($cm^2$) of each electrode plate.

(Preparation of Developer)

Developers A to H are prepared using the combination of a toner and a carrier as shown in Table 3 and mixing 100 parts by weight of the carrier and 5 parts by weight of the toner for 30 minutes while stirring in a V blender.

TABLE 3

| Developer | Toner | Carrier |
|---|---|---|
| A | 1 | 1 |
| B | 2 | 1 |
| C | 3 | 1 |
| D | 4 | 1 |
| E | 5 | 1 |
| F | 1 | 2 |
| G | 1 | 3 |
| H | 1 | 4 |
| I | 1 | 5 |

(Image Formation and Evaluation)

Developers A to H are evaluated using a remodeled machine of an electrophotographic copying machine "DocuPrint 1100CF" (trade name; product of Fuji Xerox).

Under the conditions of 20° C. and 50% RH, a chart including a halftone image, a photographic image, and a solid image and having an image density of 5% is output to an A2 200-m roll of high-quality paper (E) (product of Fuji Xerox) processed into a 12,000-m roll.

A charge amount, an image density, and fog in a non-image portion are confirmed at the initial stage, at the time of printing of 1,000,000 sheets in terms of A4 paper, and at the time of printing of 2,000,000 sheets in terms of A4 paper. The chart is output to roll paper having a width corresponding to the length of the long side of A4 paper and printing of the length corresponding to the short side of A4 paper (210 mm) is regarded as printing of one sheet of A4 paper.

(Measurement Method of Charge Amount)

A toner charge amount in an evaluation test using a real machine is measured by collecting about 0.3 g of a developer on a magsleeve in a developing unit and measuring the toner charge amount of it by using "TB200" (trade name; product of KYOCERA Chemical) in accordance with the blow-off method under the conditions of 20° C. and 50% RH at the time of printing the above-described numbers of sheets.

[Measurement of Image Density]

An optical density of the solid image portion is measured using an X-rite densitometer at the time of printing the above-described numbers of sheets. The target density is 1.4 or greater and the image density is evaluated based on the following criteria:

A: 1.4 or greater

B: exceeding 1.3 but less than 1.4

C: not greater than 1.3

[Measurement of Fog in Non-Image Portion]

A non-image portion is visually observed and evaluated based on the following criteria at the time of printing the above-described numbers of sheets:

A: No problem.

B: Fog cannot be observed visually but can be observed under a 20× loupe.

C: Fog can be confirmed by visual observation.

Evaluation results of Developers A to I are shown below in Table 4.

TABLE 4

| | | Initial stage | | | After printing on 1,000,000 sheets of A4 paper | | | After printing on 2,000,000 sheets of A4 paper | | |
|---|---|---|---|---|---|---|---|---|---|---|
| | Developer | Charge amount (μC/g) | Density | Fog | Charge amount (μC/g) | Density | Fog | Charge amount (μC/g) | Density | Fog |
| Ex. 1 | A | 25.2 | A | A | 23.8 | A | A | 23.0 | A | A |
| Ex. 2 | B | 23.4 | A | A | 20.6 | A | B | 19.8 | A | B |
| Ex. 3 | C | 24.2 | A | A | 21.2 | A | A | 20.8 | B | A |
| Comp. Ex. 1 | D | 22.3 | A | A | 17.2 | B | C | 12.8 | C | C |
| Comp. Ex. 2 | E | 20.8 | A | B | 15.1 | C | B | 14.3 | C | C |
| Ex. 4 | F | 26.8 | A | A | 20.2 | A | A | 18.2 | B | B |
| Ex. 5 | G | 27.5 | A | A | 22.4 | B | A | 21.5 | B | A |
| Ex. 6 | H | 24.3 | A | A | 19.5 | A | B | 18.6 | B | B |
| Comp. Ex. 3 | I | 21.6 | A | B | 16.2 | B | C | 13.8 | C | C |

What is claimed is:

1. A positively chargeable two-component developer, comprising: at least a toner and a carrier, wherein the toner contains a binder resin, a colorant, a wax, and a charge control agent, the binder resin contains at least a polyester resin and an addition polymerization resin grafted with a polyolefin, the wax and the addition polymerization resin grafted with a polyolefin are contained at a wax:addition polymerization resin grafted with a polyolefin ratio of from about 40:60 to about 80:20, the carrier is a magnetic powder having a coating layer containing a methyl-containing silicone resin, the addition polymerization resin is the main chain of the graft polymer, and the polyolefin to be grafted on the addition polymerization resin is a low-density polyethylene.

2. An image forming method, comprising:

forming an electrostatic latent image on a surface of a latent image bearing member;

developing the electrostatic latent image formed on the surface of the latent image bearing member with a developer containing a toner to form a toner image, transferring the toner image formed on the surface of the latent image bearing member to a surface of a transfer-receiving material, and optically fixing the toner image transferred to the surface of the transfer-receiving material, wherein the developer is the positively chargeable two-component developer as claimed in claim 1.

3. The image forming method of claim 2, wherein the method is performed using an image forming apparatus, the image forming apparatus comprising:

the latent image bearing member, a charging unit that charges the latent image bearing member, an exposing unit that exposes the charged latent image bearing member to form an electrostatic latent image on the latent image bearing member, a developing unit that develops the electrostatic latent image with the developer containing a toner to form a toner image, a transferring unit that transfers the toner image from the latent image bearing member to a surface of the transfer-receiving material, and a fixing unit that optically fixes the toner image transferred to the surface of the transfer-receiving material.

4. The developer according to claim 1, wherein the methyl-containing silicone resin is represented by Formula (1):

$$(R_nSiO_{(4-n)/2})_m$$

wherein R represents a substituent, n represents an integer from 1 to 3, m represents an integer of 2 or greater;

at least one R is a methyl group; and when n represents an integer of 2 or 3, each R may be the same or different.

5. The developer according to claim 4, wherein n is an integer of 2 or 3, one R is a methyl group, and the remaining R may individually be selected from the group consisting of an alkyl group, an alkyl fluoride group, an aryl group, a vinyl group, a hydrogen atom, a halogen atom, an alkyoxy group, an acyloxy group, and an alkylamino group.

* * * * *